US010161051B2

(12) United States Patent
Palmore et al.

(10) Patent No.: US 10,161,051 B2
(45) Date of Patent: Dec. 25, 2018

(54) ELECTROCHEMICAL REDUCTION OF CO2 AT COPPER NANOFOAMS

(71) Applicant: BROWN UNIVERSITY, Providence, RI (US)

(72) Inventors: G. Tayhas R. Palmore, Providence, RI (US); Sujat Sen, Providence, RI (US); Dan Liu, Providence, RI (US)

(73) Assignee: Brown University, Providence, RI (US)

( * ) Notice: Subject to any disclaimer, the term of this patent is extended or adjusted under 35 U.S.C. 154(b) by 50 days.

(21) Appl. No.: 15/026,304

(22) PCT Filed: Oct. 3, 2014

(86) PCT No.: PCT/US2014/058961
§ 371 (c)(1),
(2) Date: Mar. 31, 2016

(87) PCT Pub. No.: WO2015/051211
PCT Pub. Date: Apr. 9, 2015

(65) Prior Publication Data

US 2016/0215404 A1 Jul. 28, 2016

Related U.S. Application Data

(60) Provisional application No. 61/886,152, filed on Oct. 3, 2013, provisional application No. 62/031,398, filed on Jul. 31, 2014.

(51) Int. Cl.
*C25B 11/04* (2006.01)
*C25B 11/03* (2006.01)
*C25B 3/04* (2006.01)

(52) U.S. Cl.
CPC ..... *C25B 11/035* (2013.01); *C25B 3/04* (2013.01); *C25B 11/04* (2013.01); *C25B 11/0415* (2013.01); *C25B 11/0447* (2013.01)

(58) Field of Classification Search
CPC ..... C25B 11/035; C25B 11/0047; C25B 11/0415; C25B 11/04; C25B 3/04
See application file for complete search history.

(56) References Cited

U.S. PATENT DOCUMENTS

2013/0048506 A1 2/2013 Chen
2013/0105328 A1 5/2013 Cha et al.
(Continued)

FOREIGN PATENT DOCUMENTS

WO 2012082717 A2 6/2012
WO 2012125053 A2 9/2012

OTHER PUBLICATIONS

Shin, et al. "Nanoporous Structures Prepared by an Electrochemical Deposition Process," Advanced Materials, vol. 15, No. 19, Oct. 2003, p. 1610-1614.*
(Continued)

*Primary Examiner* — J. Christopher Ball
(74) *Attorney, Agent, or Firm* — Polsinelli PC

(57) ABSTRACT

This invention includes a catalytic copper electrode is selected from the group comprising copper nanofoam, copper aerogel, and copper nanoparticles. Particular note is made of the catalytic copper electrode having at least about 5 times and preferably about 10 times the electrochemically accessible surface area as determined by the Randles-Sevcik equation at 50 mV/s. particular note is made of the catalytic coper electrode being a copper nanofoam electrode.
This invention further includes a method for the reduction of $CO_2$ by the steps of (i) providing a membrane divided electrochemical cell comprising an anode in a first cell compartment, a catalytic-copper electrode in a second cell compartment containing an aqueous electrolyte in contact with the anode and cathode; (ii) introducing $CO_2$ to said second cell compartment (iii) exposing said $CO_2$ to said catalytic-copper electrode at a step potential between about
(Continued)

−0.8 and preferably about −1.0 and about −1.8 V versus the reference electrode; (iv) electrochemically reducing said $CO_2$ and solution by the catalytic-copper electrode in the second cell compartment; (v) thereby producing propylene and (vi) extracting said propylene from said second compartment.

7 Claims, 7 Drawing Sheets

(56) References Cited

U.S. PATENT DOCUMENTS

| | | | |
|---|---|---|---|
| 2013/0228470 | A1 | 9/2013 | Chen |
| 2013/0233722 | A1 | 9/2013 | Chen |

OTHER PUBLICATIONS

Tang, et al. "The importance of surface morphology in controlling the selectivity of polycrystalline copper for CO2 electroreduction," Physical Chemistry Chemical Physics, vol. 14.*

Noda, et al. "Potential Dependencies of the Products of Electrochemical Reduction of Carbon Dioxide at a Copper Electrode," Chemistry Letters, 1989, p. 289-292.*

Chow, et al. "3D-Addressable Redox: Modifying Porous Carbon Electrodes with Ferrocenated 2 nm Gold Nanoparticles," Journal of Physical Chemistry, C, vol. 116, Apr. 2012, p. 9283-9289.*

C.W. Li & M.W. Kanan, "CO2 Reduction at Low Overpotential on Cu Electrodes Resulting from the Reduction of Thick Cu2O Films", Journal of the American Chemical Society, vol. 134, No. 17, p. 7231-7234 + S1-514, Apr. 2012.*

* cited by examiner

Fig. 1 (a) and (b)

Fig. 3a and b
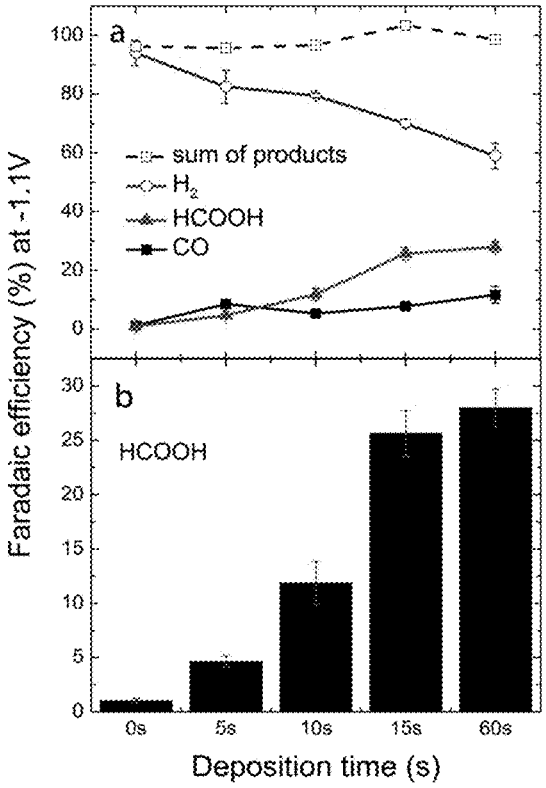
Fig. 4
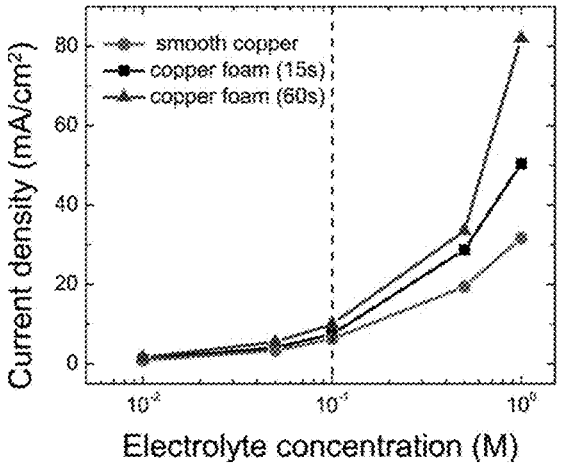

Fig. 5a
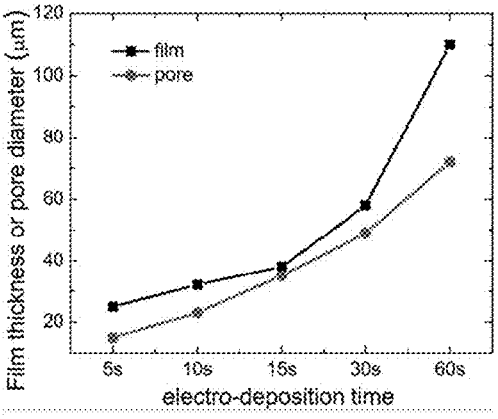
Fig. 5b
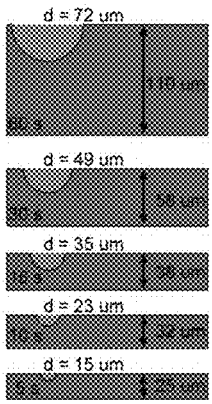
Fig 5 c,d, and e
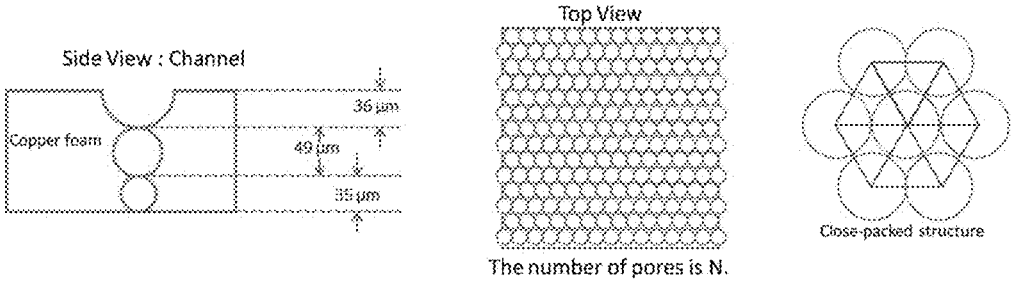

ELECTROCHEMICAL REDUCTION OF CO2 AT COPPER NANOFOAMS

CROSS REFERENCE TO RELATED APPLICATIONS

This is a national stage application under 35 U.S.C. § 371 of International Application No. PCT/US2014/058961, filed Oct. 3, 2014, and claims the benefit of U.S. Provisional Application No. 61/886,152, filed Oct 3, 2013, and U.S. Provisional Application No. 62/031,398, filed Jul. 31, 2014, the disclosures of which are incorporated by reference herein in their entirety.

STATEMENT OF GOVERNMENT RIGHTS

This invention was made with government support under CHE-1240020 awarded by National Science Foundation. The government has certain rights in the invention.

FIELD OF THE INVENTION

The three dimension structure of copper nanofoams provide for electrocataclytic chemical reduction of $CO_2$. In some embodiments, copper nanofoam with hierarchical porosity is disclosed. Both the distribution of products formed from this reaction and their faradaic efficiencies differ significantly from that obtained at smooth electropolished copper electrodes with particular reference to the production of propylene. Without being bound by any particular theory, high surface roughness, hierarchical porosity, and confinement of reactive species promotes $CO_2$ reduction.

BACKGROUND OF THE INVENTION

Electrochemical reduction of $CO_2$ has been investigated at a variety of metallic electrodes and a number of reports and reviews have been published on this subject. Published materials are presented below. These references and their teachings as well as all publications cited herein are incorporated by reference in their entirety.

1) Hori, Y.; Murata, A.; Kikuchi, K.; Suzuki, S. *J. Chem. Soc., Chem. Commun.* 1987, 728-729.

2) Hoshi, N.; Kawatani, S.; Kudo, M.; Hori, Y. *J. Electroanal. Chem.* 1999, 467, 67-73.

3) Hori, Y.; Murata, A.; Takahashi, R. *J. Chem. Soc., Faraday Trans.* 1 1989, 85, 2309-2326.

4) Hori, Y.; Murata, A. *Electrochim. Acta* 1990, 35, 1777-1780.

5) Tomita, Y.; Hori, Y. In *Stud. Surf. Sci. Catal.;* T. Inui, Anpo, M., Izui, K., Yanagida, S., Yamaguchi, T., Eds.; Elsevier: 1998; Vol. 114, p 581-584.

6) Jhong, H.-R. M.; Ma, S.; Kenis, P. J. *A. Curr. Opin. Chem. Eng.* 2013, 2, 191-199.

7) Gattrell, M.; Gupta, N.; Co, A. *J. Electroanal. Chem.* 2006, 594, p. 1-19.

8) Hori, Y. In *Modern Aspects of Electrochemistry;* Vayenas, C., White, R., Gamboa-Aldeco, M., Eds.; Springer New York: 2008; Vol. 42, p 89-189.

9) Ohta, K.; Kawamoto, M.; Mizuno, T.; Lowy, D. A. *J. Appl. Electrochem.* 1998, 28, 717-724.

10) Hori, Y.; Konishi, H.; Futamura, T.; Murata, A.; Koga, O.; Sakurai, H.; Oguma, K. *Electrochim. Acta* 2005, 50, 5354-5369.

11) Hori, Y.; Murata, A.; Takahashi, R.; Suzuki, S. *J. Chem. Soc., Chem. Commun.* 1988, 17-19.

12) Hori, Y.; Takahashi, I.; Koga, O.; Hoshi, N. *J. Phys. Chem. B* 2002, 106, 15-17.

13) Hori, Y.; Takahashi, R.; Yoshinami, Y.; Murata, A. *J. Phys. Chem. B* 1997, 101, 7075-7081.

14) Hori, Y.; Wakebe, H.; Tsukamoto, T.; Koga, O. *Electrochim. Acta* 1994, 39, 1833-1839.

15) Kuhl, K. P.; Cave, E. R.; Abram, D. N.; Jaramillo, T. F. *Energy Environ. Sci.* 2012, 5, 7050-7059.

16) Li, C. W.; Kanan, M. W. *J. Am. Chem. Soc.* 2012, 134, 7231-7234.

17) Schouten, K. J. P.; Kwon, Y.; van der Ham, C. J. M.; Qin, Z.; Koper, M. T. M. *Chem. Sci.* 2011, 2, 1902-1909.

18) Tang, W.; Peterson, A. A.; Varela, A. S.; Jovanov, Z. P.; Bech, L.; Durand, W. J.; Dahl, S.; Norskov, J. K.; Chorkendorff, I. *PCCP* 2012, 14, 76-81.

19) Reske. R; Mistry, H; Behafarid, F; Cuenya, B. R.; Strasser, P.; *J. Am. Chem. Soc.* 2014, 136, 6978-6986.

20) Lu, Q.; Rosen, J.; Zhou, Y.; Hutchings, G.S.; Kimmel, Y.C.; Chen, J. G.; Jiao, F. *Nat. Commun.* 2014, 5, 3242-3248.

21) Durand, W. J.; Peterson, A. A.; Studt, F.; Abild-Pedersen, F.; Norskov, J. K. *Surf. Sci.* 2011, 605, 1354-1359.

22) Peterson, A. A.; Abild-Pedersen, F.; Studt, F.; Rossmeisl, J.; Norskov, J. K. *Energy Environ. Sci.* 2010, 3, 1311-1315.

23) Hansen, H. A.; Varley, J. B.; Peterson, A. A.; Nørskov, J. K. *J. Phys. Chem. Lett.* 2013, 4, 388-392.

24) Peterson, A. A.; Nørskov, J. K. *J. Phys. Chem. Lett.* 2012, 3, 251-258.

25) Shin, H. C.; Dong, J.; Liu, M. *Adv. Mater.* 2003, 15, 1610-1614.

26) Boo, H.; Park, S.; Ku, B.; Kim, Y.; Park, J. H.; Kim, H. C.; Chung, T. D. *J. Am. Chem. Soc.* 2004, 126, 4524-4525.

27) Bae, J. H.; Han, J.-H.; Chung, T. D. *PCCP* 2012, 14, 448-463.

28) Shin, H. C.; Dong, J.; Liu, M. *Adv. Mater.* 2003, 15, 1610-1614.

29) Trahey, L.; Vaughey, J. T.; Kung, H. H.; Thackeray, M. M. *J. Electrochem. Soc.* 2009, 156, A385-A389.

30) Kuhl, K. P.; Cave, E. R.; Abram, D. N.; Jaramillo, T. F. *Energy Environ. Sci.* 2012, 5, 7050-7059.

31) Kim, H.-J.; Jeon, W. S.; Ko, Y. H.; Kim, K. *Proc. Natl. Acad. Sci. U.S.A,* 2002, 99, 5007-5011.

32) Nouel, et al., "Nafion®-based composite polymer electrolyte membranes," *Electrochimica Acta,* 43(16-17); 2381-2387 (29 May 1998).

SUMMARY OF THE INVENTION

This invention includes a catalytic copper electrode is selected from the group comprising copper nanofoam, copper aerogel, and copper nanoparticles. Particular note is made of the catalytic copper electrode having at least about 5 times and preferably about 10 times the electrochemically accessible surface area as determined by the Randles-Sevcik equation at 50 mV/s. Particular note is made of the catalytic coper electrode being a copper nanofoam electrode.

This invention further includes a method for the reduction of $CO_2$ by the steps of (a) providing a membrane divided electrochemical cell comprising an anode in a first cell compartment, a catalytic-copper electrode in a second cell compartment containing an aqueous electrolyte in contact with the anode and cathode;

(b) introducing $CO_2$ to said second cell compartment (c) exposing said $CO_2$ to said catalytic-copper electrode at a step potential between about −0.8 and preferably about −1.0 and about −1.8 V versus the reference electrode (e.g., Ag/AgCl);

(d) electrochemically reducing said $CO_2$ and solution by the catalytic-copper electrode in the second cell compartment;

(e) thereby producing propylene; and, (f) extracting said propylene.

Mention of the Ag/AgCl reference electrode is cited solely to establish voltages of the method. A variety of reference electrodes are known in the art and suitable.

In some embodiments of the method the catalytic copper electrode is selected from the group comprising copper nanofoam, copper aerogel, and coper nanoparticles. In further embodiments of the method the copper nanofoam electrode has at least about 5 times and preferably about 10 times the electrochemically accessible surface area as determined by the Randles-Sevcik equation at 50 mV/s. In particular embodiments the method of employs the electrolyte $KHCO_3$. Electrolyte concentrations of from about 0.5 M to about 0.1 M are specifically noted.

BRIEF DESCRIPTION OF THE DRAWINGS

FIG. 3*a* presents the product distribution obtained from the electrochemical reduction of $CO_2$ at different copper nanofoams using an applied potential of only −1.1 V where $H_2$, HCOOH, and CO are the major products.

FIG. 3*b* presents the faradaic efficiency of HCOOH as a function of increasing thickness (and total area of stepped surface) of the copper nanofoams.

FIG. 4. Presents chronoamperometric data of $CO_2$ electroreduction at smooth and copper nanofoam electrodes plotted as a function of electrolyte concentration, where the electrolyte was $KHCO_3$ saturated with $CO_2$ and the step potential was −1.8 V. The dashed line corresponds to the electrolyte concentration used for all electrolysis experiments performed in this study, where the step potential varied between −1.0 and −1.8

FIG. 5*a* shows the variation in film thickness and surface pore size of the copper nanofoams as a function of electrodeposition time.

FIG. 5*b* shows the relative size of pores to nanofoam thickness.

FIGS. 5*c d,* and *e* are drawings showing a conceptual model of relative size of nanofoam thickness and surface pore diameter for each sample.

FIG. 6 inset is a diagram of electro-active area vs deposition time.

DETAILED DESCRIPTION OF THE INVENTION

Figure 1:
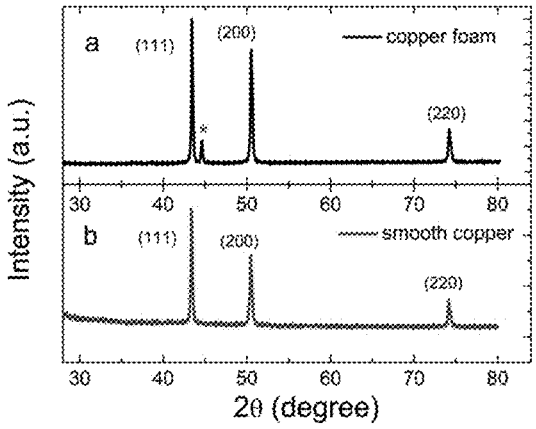
FIG. 1*a* is the X-ray diffractogram (XRD) of electrodeposited copper nanofoam on an aluminum substrate coated with copper nanofoam (upper) (* corresponds to the (111) peak of the underlying Al substrate).
FIG. 1*b* is an XRD of polycrystalline copper substrate.

Electrocatalytic chemical reduction of $CO_2$ at copper nanofoams yields formic acid at a lower onset potential with faradaic efficiencies that are 10-20% higher than other reported values. In comparison to smooth copper electrodes, the faradaic efficiencies of CO, methane, and ethylene are reduced significantly while C2 and C3 products such as ethane and propylene are produced. Ethane and propylene production has been observed in the instant copper nanofoam system. Without being bound by any particular theory, it is believed that presence of ethane and propylene suggests that copper nanofoams employed as electrocatalysts provide both the nanostructured surfaces and cavities that facilitate the reaction between adsorbed $CO_2$ and hydrogen species to generate higher order hydrocarbons during the electrochemical reduction of $CO_2$.

Particular note is made of the term electrocatalyst. As used herein, an electrocatalyst is a catalyst that participates in electrochemical reactions. Catalyst materials modify and increase the rate of chemical reactions without being consumed in the process. Electrocatalysts are a specific form of catalysts that function at electrode surfaces or may be the electrode surface itself as embodied in the copper nanofoams disclosed herein.

Without being bound by any particular theory, generation of C3-products such as propylene (observation iv) in the present system are believed associated with the hierarchical porous nature of the copper nanofoams. Increasing the electrodeposition time results in an increase in the thickness of the copper nanofoam (and depth of "channels") with a simultaneous increase in the pore diameter as the distance from the substrate increases. Thus, a gradient of pore diameters exists in the nanofoam structure, which yields labyrinthine channels with conical-like shapes where the tip of the cone occurs at the underlying copper substrate. Within these channels are nano-scale dendritic features surrounded by nano-scale cavities of electrolyte. Consequently, the residence times of various intermediates within these confined volumes increases, resulting in the production of products not observed at a smooth Cu electrode (e.g., propylene). Mechanistically it is assumed that within a nanopore, the electrical double layer (EDL) overlaps, thereby overlapping the corresponding electric field. Overlapping EDL occurs easily in nanoporous structures because the thickness of the EDL is considerably larger than the volume within the pores. Even when a high overpotential is applied, the inner surface area of the pore is not accessible. These three-dimensional electroactive areas, if small enough, are believed to reduce the kinetics of desorption of surface intermediates and consequently enable the production of C2 or C3 products such as propylene by increasing the residence time of surface intermediates. Unwanted hydrogen evolution reaction is believed to become more favorable above 0.5 M electrolyte, and is to be avoided.

Further and without being bound by any particular theory it is believed that the electrocatalyst of the present invention assist in transferring electrons between the electrode and reactants, and/or facilitating intermediate chemical transformations described by an overall half-reaction. One proposed mechanism is that $CO_2$ and CO resides or repeatedly interacts with the electrocatalyst surface and further interacts with other surface bound CO or $CO_2$ moieties to further the reduction reaction.

Open-cells in the copper nano foam facilitate interactions as do dendritic surface elements on the electrode surface (which may be within a bubble). Interactions are understood to be for seconds or longer. Other models for electrocatalysts include surface enhancing and entrapping copper foams that are of particularly open-cell construction, and an electrocatalyst incorporating copper nanoparticles or sintered nanoparticles that offer, along with suitable flow, residence times and repeated interaction opportunities for gas being reacted. A copper surfaced electrode in the form of an aerogel is also contemplated as is a column of copper nanoparticles. In some embodiments of open-cell nanofoam from about 75% to about 95% of the volume consists of void spaces. Electrodes as offered herein are broadly termed catalytic-copper electrodes.

The term electrocatalyst is used in distinction from an electrode which is merely an electrical conductor used to make contact with a nonmetallic part of a circuit—but not a catalytic function.

Particular attention is drawn to copper nanofoam electrocatalyst electrodes of copper metal with pore inclusions wherein said pore inclusions have an average diameter of from about 20-50 μm. Note is also made of pores in the range of 10-200 μm; 20-100 μm and 100-150 μm. To be "visible" to $CO_2$ the pores of interest will be understood to be open to the surface or otherwise accessible. A variety of channels and configurations will be understood by those skilled in the art to meet this criteria. For example, a cylindrical copper foam billet is easily surface machined to expose what would initially be sub-surface bubbles or pores.

Figure 6:
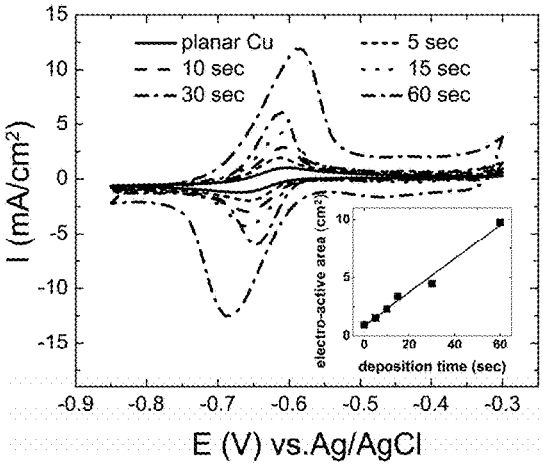
FIG. 6 presents cyclic voltammograms of 10 mM methyl viologen in 1 M $Na_2SO_4$ at 50 mV/s using copper nanofoams that were electrodeposited for different lengths of time.

Particularly suitable electrodes of the present invention have about 5 times and preferably about 10 times the electrochemically accessible surface area for each electrode as determined by the Randles-Sevcik equation at 50 mV/s, as seen in the inset in FIG. 6. FIG. 6 presents cyclic voltammograms of 10 mM methyl viologen in 1 M $Na_2SO_4$ at 50 mV/s using copper nanofoams that were electrodeposited for different lengths of time.

In one embodiment, nanofoams of copper were electrodeposited onto mechanically polished copper substrates using the procedure of Shin, H. C et al., *Adv. Mater.* 2003, 15, 1610-1614. This procedure resulted in a metal foam with hierarchical porosity suitable for the present invention.

Evolution of hydrogen gas at an electrode surface is believed significant during the electro-deposition of copper when a high current density is maintained (typically >0.5 $A/cm^2$). Without being bound by any particular theory, the evolution of hydrogen gas is believed to impede electrodeposition of copper directly onto the cathode by temporarily preventing contact between the copper cathode and the electrolyte that contains copper sulfate. Eventually, a thin film of electrolyte surrounding a $H_2$ bubble comes into contact with the cathode, which completes the electrochemical circuit and allows for the electrodeposition of copper. The resulting nanofoam is a connected network of copper pores templated by $H_2$ bubbles. Copper nanofoams appear reddish when freshly electro-deposited but gradually dull with exposure to air as the copper is oxidized. Nanoscale dendritic structures protrude from the walls of the pores. The pore diameter (here, 20-50 μm) can be controlled by electrodeposition parameters such as concentration of copper salts from 1 micromolar to 1 molar, pH from 0 to 12, and deposition times from 1 second to 10 hours.

Shown in FIG. 1*a* is the X-ray diffractogram (XRD) of electrodeposited copper nanofoam on an aluminum substrate. FIG. 1*a* show copper nanofoams with face-centered cubic structure (fcc) with high crystallinity and peaks corresponding to the (111), (200), and (220) crystal facets. The ratios of different pairs of crystal facets for the copper nanofoam electrode are 1.24 for (111):(200), 3.6 for (111):(220) and 2.9 for (200):(220). For comparison, the XRD of a polycrystalline copper substrate is shown in FIG. 2*b*, which also exhibits the (111), (200), and (220) crystal facets. The ratios of different pairs of crystal facets are 1.61 for (111):(200), 3.7 for (111):(220) and 2.3 for (200):(220). Although identical facets are observed in both samples, the amount of (200) facet is ~22% higher in the copper nanofoams than in the smooth electrode (see supporting information).

FIG. 1. Shows (a) XRD patterns of an Al substrate coated with copper nanofoam (upper) (* corresponds to the (111) peak of the underlying Al substrate), and (b) an uncoated polycrystalline copper substrate.

Figure 2:
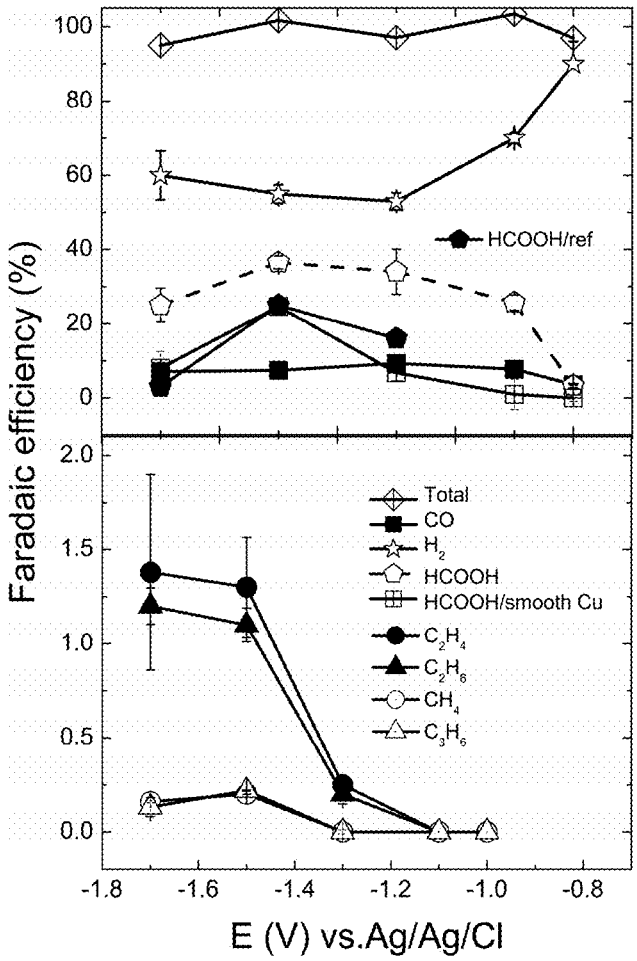
FIG. 2. presents faradaic efficiencies of the various products obtained from the electro-reduction of $CO_2$ at a copper nanofoam (15 s electrodeposit) plotted as a function of applied voltage.

Shown in FIG. 2 are the faradaic efficiencies of the various products obtained from the electro-reduction of $CO_2$ at a copper nanofoam (15 s electrodeposit) plotted as a function of applied voltage. The sum of the faradaic yield for all products approached 100% across the entire potential range. Major products were HCOOH, $H_2$ and CO, minor products (<2%) were $C_2H_4$, $C_2H_6$, $CH_4$ and $C_3H_6$. Very small amounts of methanol and ethanol also were detected (<1%) but were not quantified. The faradaic efficiency for HCOOH at a smooth copper electrode that was electropolished prior to use was found to be 24% at −1.5V in 0.1 M $KHCO_3$, pH 6.8.

The onset potential for electro-reduction of $CO_2$ at copper nanofoam electrodes was −1.0 V Ag/AgCl, at which the faradaic efficiency of HCOOH was 3-4%. This value increased to 26% at −1.1 V, which is significantly higher than that obtained at a smooth copper electrode (i.e., <1% at −1.1 V). In fact, the faradaic efficiency of HCOOH produced at copper nanofoam electrodes was higher at all potentials with a maximum efficiency of 37% at −1.5V, which is the highest value obtained for the electro-reduction of $CO_2$ to HCOOH at a copper electrode under ambient pressure. Furthermore, methane ($CH_4$) and ethylene ($C_2H_4$), ethane and propylene were generated in detectable quantities. Significantly, propylene has not been observed previously in the products of $CO_2$ electro-reduction at copper electrodes.

FIG. 2. diagrams product distribution as a function of applied potential during the electrochemical reduction of $CO_2$. The working electrode was a copper nanofoam electrodeposited for 15 seconds. Data for the electrochemical reduction of $CO_2$ to formate at a smooth copper electrode (both from our laboratory and from the literature) are included for comparison.

Experimental evidence that suggests the mechanism of $CO_2$ electroreduction is altered by the nanofoams comes from (i) increased faradaic efficiency for formate at all potentials, (ii) decreased faradaic efficiency for CO, $CH_4$ and $C_2H_4$, (iii) production of saturated hydrocarbons, namely $C_2H_6$, and (iv) generation of novel C3 products, namely $C_3H_6$. Insight into the significance of i-iii is provided by the detailed theoretical description of the chemical processes that occur at the copper-water interface during electrochemical reduction of $CO_2$ by Norskov et al.[21,22] In their studies, the electrochemical reaction was simulated using the computational hydrogen electrode (CHE) model coupled with adsorption energies of various reduction intermediates obtained from density functional theory (DFT) calculations.

Voltage-dependent pathways for $CO_2$ reduction at copper surfaces were predicted: the formate (OCHO) or F-intermediate pathway, which leads exclusively to formic acid, or the carboxyl (COOH) or C-intermediate pathway, a branched pathway that leads to formic acid and higher order hydrocarbons. Calculations for both pathways were performed on (111), (100) and (211) surfaces of copper. Without being bound by any particular theory, the electrochemical reduction of $CO_2$ at copper is believed to proceed through a series of steps (1-6) in the Electrochemical Scheme Table (below). The competing hydrogen evolution reaction proceeds through two steps (7 and 8). The asterisk (*) in any step denotes either a surface-bound species or a vacant, catalytically active site.

On (111) and (100) surfaces, the F-intermediate pathway is believed dominates since it has the lowest change in free energy of the two pathways.[21] Assuming (100) and (200) surfaces to be equivalent in DFT calculations, production of HCOOH via the F-intermediate pathway (steps 1 to 3 to 4) is expected to be enhanced at Cu nanofoams, where 22% more (200) surface is observed.

| Electrochemical Scheme Table Steps | |
|---|---|
| $CO_2 + H^+(aq) + e^- + * \rightarrow HCOO^*$(F - intermediate) | (1) |
| $CO_2 + H^+(aq) + e^- + * \rightarrow COOH^*$(C - intermediate) | (2) |
| $HCOO^*/COOH^* + H^+(aq) + e^- \rightarrow HCOOH^*$ | (3) |
| $HCOOH^* \rightarrow HCOOH + *$ | (4) |
| $COOH^* + H^+(aq) + e^- \rightarrow CO^* + H_2O$ | (5) |
| $CO^* + H^+(aq) + e^- \rightarrow CHO^*$ | (6) |
| $H^+(aq) + e^- + * \rightarrow H^*$ | (7) |
| $H^* + H^+(aq) + e^- \rightarrow H_2 + *$ or $H^* + H^* \rightarrow H_2 + 2^*$ | (8) |

The free energy diagrams provided by DFT calculations also indicate that production of HCOOH at the (211) surface should be favored over (111) and (100) surfaces. While the (211) surface is not observed experimentally, it can be used to model defects such as surface steps, which are found on rough surfaces. Experimental evidence in support of this prediction can be obtained by measuring the faradaic efficiency of HCOOH generated at Cu nanofoams of increasing thickness (and therefore, increasing total area of rough or highly stepped surfaces). The relative increase in surface area of copper nanofoams electrodeposited for different amounts of time was measured by analyzing voltammetric and SEM data, which are provided in supporting information. Shown in FIG. 3*a* is the product distribution obtained from the electrochemical reduction of $CO_2$ at different copper nanofoams using an applied potential of only −1.1 V where $H_2$, HCOOH, and CO are the major products. Highlighted in FIG. 3*b* is the faradaic efficiency of HCOOH as a function of increasing thickness (and total area of stepped surface) of the copper nanofoams. The maximum value obtained was 29% using a copper nanofoam that was electrodeposited for 60 seconds. This value is one of the highest values reported at copper (with the exception of 33% at −1.1 V using a copper oxide surface).[16] This value, however, is not much higher than the faradaic efficiency obtained at copper nanofoams electrodeposited for shorter times (i.e., 26% at 15 seconds), suggesting the effect of surface roughness may taper as the nanofoams become thicker (i.e., electrodeposition times >60 seconds). Nevertheless, these results confirm theoretical predictions that surface roughness has a dominant role in the faradaic efficiency of HCOOH despite the 22% increase in the (100) surface in the copper nanofoams.

DFT calculations on (111), (100) and (211) surfaces of copper also indicate the (211) surface is more likely than (111) and (100) surfaces to be involved in $CO_2$ activation and reduction to hydrocarbon products. Hydrocarbon production is predicted to occur via a branch in the C-intermediate pathway that goes through a CO. intermediate (steps 2 to 5 to 6).[22] This prediction was confirmed experimentally, where an increase in selectivity toward ethylene generation (14% vs. 23% vs. 37%) corresponded to copper electrodes of increasing roughness (electropolished<sputter coated<nanoparticle coated, respectively), while concurrently yielding very low amounts of HCOOH (i.e., <8%).[18] Comparing these results to those obtained with copper nanofoams indicates (1) surface roughness alone does not account for the high faradaic efficiencies for HCOOH production at copper nanofoams and (2) the branch of the C-intermediate pathway that goes through a CO. intermediate appears to be suppressed at copper nanofoams since very low faradaic efficiencies for CO (and its subsequent products, $CH_4$ and $C_2H_4$) are observed.

FIG. 4. presents chronoamperometric data of $CO_2$ electroreduction at smooth and copper nanofoam electrodes plotted as a function of electrolyte concentration, where the electrolyte was $KHCO_3$ saturated with $CO_2$ and the step potential was −1.8 V. The dashed line corresponds to the electrolyte concentration used for all electrolysis experiments performed in this study, where the step potential varied between −1.0 and −1.8 V.

Gouy-Chapman theory[26] relates the Debye length of the EDL to electrolyte concentration, where the thickness of the EDL decreases as the concentration of the electrolyte increases. At a critical concentration of electrolyte, the EDL becomes sufficiently thin such that electric field of adjacent pores no longer overlap. Instead, the electric field maps the exact shape of the pores, thereby providing additional surface area to participate in the electrochemical reaction. Chronoamperometric experiments (FIG. 5) reveal that the current density at a smooth copper electrode increases gradually from 7 to 31 mA/cm$^2$ (~4.5×) as the electrolyte concentration increases from 0.1 to 1 M. In contrast, the current density at a copper nanofoam (60 s sample) increases steeply from 10 to 82 mA/cm$^2$ (~8×) above a concentration of approximately 0.5 M $KHCO_3$. Concentrations of this level 0.5 M and up to about 1 Molar will favor the competing hydrogen evolution reaction. Concentrations above about 1 Molar to about 10 Molar further enhance the competing hydrogen evolution reaction. Concentrations below about 0.5 M enhance CO2 electrocatalytic reduction.

It is evident from this data that nanoscale pores are present within the copper nanofoam electrodes, which become accessible at concentrations above 0.5 M $KHCO_3$ (i.e., where the thickness of the double-layer in minimized and does not overlap within a three-dimensional nanopore or channel).

The results presented herein demonstrate that the electroreduction of $CO_2$ at copper nanofoams differs from that observed at smooth copper electrodes with respect to the onset potential, products formed, and their potential dependent distribution. Products from the electro-reduction of $CO_2$ were observed at −1.0 V, indicating an onset potential that is −200 mV more positive than that required at smooth copper electrodes. This decrease in overpotential may be a consequence of the higher (200) surface orientation in the copper nanofoams (by 22%) compared to smooth copper. Furthermore, the electro-reduction of $CO_2$ at copper nanofoams at different potentials yielded a different product distribution compared to that at smooth copper (most notably, the faradaic efficiency of formate was 26% at −1.1 V compared to only 3% at smooth copper). The enhanced faradaic efficiency of HCOOH, the decreased faradaic efficiency of methane and ethylene, and the presence of ethane and propylene (not observed at smooth copper) at copper nanofoams suggest that the electro-reduction of $CO_2$ follows both the F-intermediate and C-intermediate pathways, with the C-intermediate pathway to HCOOH becoming more dominant as the thickness (and total amount of stepped surface) of the copper nanofoam increases. Systematically increasing the thickness of the copper nanofoams further enhances the faradaic efficiency of HCOOH up to 29% by suppressing the electrochemical reduction of adsorbed H. to $H_2$. Finally, evidence is provided that some areas within the copper nanofoams only become electrochemically accessible above a critical concentration of electrolyte.

In summary, the copper nanofoams used in this study reveal that novel electrode architectures offer another approach to affecting the products formed during the electrochemical reduction of $CO_2$. Studies that examine how systematic changes in pore diameter, pore depth, and electrolyte concentration affect the products obtained from the electrochemical reduction of $CO_2$ are ongoing and will be reported elsewhere.

Materials and Experimental Methods

High purity potassium bicarbonate (99.99%, Sigma Aldrich), copper sulfate (Mallinckrodt, 97%), sulfuric acid (98%, Fisher Scientific), and $CO_2$ (99%, USP 2.0, Corp Brothers, Inc.) and $N_2$ (99%, commercial grade, Corp Brothers, Inc.) were used as received. Electrodes were made from copper foil (0.25 mm thickness, 99.9% purity, Goodfellow). Electrolyte solutions were prepared using deionized water.

1.1 Electrodeposition of Copper Nanofoams

A working electrode was fabricated out of a copper plate, mechanically polished with 400 grade sandpaper, and rinsed in water and acetone prior to use. Copper nanofoams were prepared using reported methods.[28,29] Briefly, a copper plate working electrode and a copper gauze counter electrode were immersed in a solution containing 0.2 M copper sulfate and 1.5 M $H_2SO_4$. A potential of −6 V was applied to the working electrode for different lengths of time in unstirred electrolyte using a DC power supply.

1.2 Electrolysis Experiments

Electrolysis experiments were performed in an H-cell, under potentiostatic conditions over a range of applied voltages (−1 V to −1.8 V). The copper nanofoams (electrodeposited for 5, 10, and 15 seconds) were found to be the most mechanically robust of the nanofoams, where the nanofoam remained completely intact during preparation, handling and electrolysis. Small pieces of the nanofoam from thicker samples were observed in the catholyte during setup of the electrolysis experiments but unchanged thereafter. Electrolysis was performed in 0.1 M $KHCO_3$ (pH 6.8) saturated with $CO_2$ using a two-compartment cell separated by a Nafion N117 membrane using a PAR 273A potentiostat to a charge between 50 and 100 coulombs. The counter and reference electrodes were platinum gauze and Ag/AgCl, respectively. Prior to electrolysis, the electrolyte was purged with $CO_2$ at a constant flow rate of 20 ml/min for 30 minutes. All potentials reported herein are referenced to the Ag/AgCl electrode (+197 mV vs. SHE).

1.3 Product Quantification

Liquid phase products were quantified using solvent suppressed 1D $^1H$ NMR (400 MHz, Bruker Avance). A 700 μl sample of the electrolyte was mixed with 35 μl of 10 mM dimethyl sulfoxide (DMSO) and 50 mM phenol for use as internal standards in $D_2O$ for NMR analysis as per previously reported procedures.[30] Current or faradaic efficiencies of each product produced were determined from the measured concentration of product divided by the concentration calculated from the number of coulombs passed during electrolysis. Gaseous products in the effluent gas stream from the cathodic half of the cell was injected via an automated sample loop into a gas chromatograph (GC, SRI 8610C Multi-gas #3 configuration).

1.4 Ex-Situ Analyses

Scanning electron microscope (SEM) images were acquired using a LEO 1530 high resolution SEM without the use of any conductive coating. Crystal structures were determined from X-ray diffractograms (XRD) obtained on a Bruker D8-Discover powder diffractometer with Cu-Ka radiation working at 40 mA and 40 kV. XRD were obtained in the 2θ range of 15 to 80 degrees, with degree steps of 0.02 and acquisition times of 0.1 s/step.

XRD: Quantitative Analysis

Calculation of % difference of (200) surface between smooth and nanofoam copper. Both (111) and (220) have the same XRD intensity in both samples (i.e., their ratios are 3.7 vs. 3.6). Peak ratio of smooth copper electrode is (3.7:2.3:1). Therefore, ratios for different pairs of facets are: 1.61 for (111):(200), 3.7 for (111):(220), and 2.3 for (200):(220). Reverse the ratio to (200):(111)=2.3/3.7=0.622 and keep ratio of (200):(220)=2.3. The bold numbers are to be compared to the other sample. Peak ratio of copper nanofoam electrode is (3.6:2.9:1). Therefore, ratios for different pairs of facets are: 1.24 for (111):(200), 3.6 for (111):(220) and 2.9 for (200):(220). Reverse the ratio to (200): (111)=2.9/3.6=0.802, and keep ratio of (200):(220)=2.9. The bold numbers are to be compared to the other sample. The ratios of these values from both samples are similar (0.622/0.802=77.6%; 2.3/2.9=79.3%) and thus, indicate that there is ~22% more (200) facets in the nanofoam electrode than in the smooth electrode.

Calculation of Surface Area Based on SEM Measurements

Diameters of pores and thicknesses of nanofoams were obtained from SEM measurements. FIG. 5*a* shows the variation in film thickness and surface pore size of the copper nanofoams as a function of electrodeposition time. Based on these measurements, the schematic included in FIG. 5*b* shows the relative size of pores to nanofoam thickness. This schematic gives insight into the structure of the nanofoams and the number of pore "layers" to consider in a calculation of surface area of the nanofoam, where the largest pore resides at the surface of the nanofoam with at least two layers of pores below. To simplify the calculation, the following approximations were made: (1) pores are spherical, uniformly sized, and close packed; pores do not overlap; surface of the pores is smooth; total length of channel formed by the pores (spheres) is less than or equal to measured thickness. Thus, the surface area of a planar copper substrate is $A_0$=1 cm*1 cm=1 $cm^2$. Assuming a close packed structure with packing efficiency of 90.7%, we can calculate the number of pores for each layer (N1, N2 and N3): N1=1 $cm^{2*}$90.7%/π (36 μm)$^2$=22,288; N2=1 $cm^{2*}$90.7%/π (49 μm/2)$^2$=48,122; N3=1 $cm^{2*}$90.7%/π (35 μm/2)$^2$=94,319. Therefore, the total area of the copper nanofoam per geometrical footprint (1 $cm^2$)=N1*[2π(36 μm)$^2$]+N2*[4π (49 μm/2)$^2$]+N3*[4π(35 μm/2)$^2$]=1.8139+3.628+3.6275=9.069 $cm^2$.

FIG. 5*a* presents thickness of the electrodeposited Cu nanofoam and average diameter of the pores at the surface of the nanofoam plotted as a function of the electro-deposition time; FIGS. 5*c,d,* and *e* are schematics showing relative size of nanofoam thickness and surface pore diameter for each sample; schematic of pore "layers" used to calculate surface area.

Cyclic voltammetry in the presence of a known concentration of a redox-active molecule (i.e., methyl viologen, FIG. 6) was used to measure the accessible electro-active surface area of copper nanofoams with different thicknesses and compared to that of a smooth electrode. The peak currents in the CVs increased with the thickness of the copper nanofoam, indicating an increase in electroactive surface area. A plot of peak current as a function of (scan rate)$^{1/2}$ for both smooth and nanofoam electrodes is linear, confirming the electrochemical process is diffusion-limited.

Inset shows the electrochemically accessible surface area for each electrode as determined by the Randles-Sevcik equation at 50 mV/s.

The Randles-Sevcik equation relates the peak current to electroactive surface area for a diffusion-limited electrochemical process. Using this equation, the diffusion coefficient ($D_0$) of methyl viologen was determined at a smooth electropolished copper electrode and found to be $4.57\times10^{-6}$ $cm^2/s$. This value is consistent with that previously reported[31] and subsequently was used to determine the electroactive surface area of each nanofoam electrode using the same equation. A good linear fit was obtained indicating no saturation in the electrochemical accessibility even for the thickest nanofoams. The thickest copper nanofoam (60 s electrodeposit) was found to have an electro-active area of 10 $cm^2$. This value is very close to the value estimated from the analysis of SEM images (i.e., 9 $cm^2$).

Figure 7:
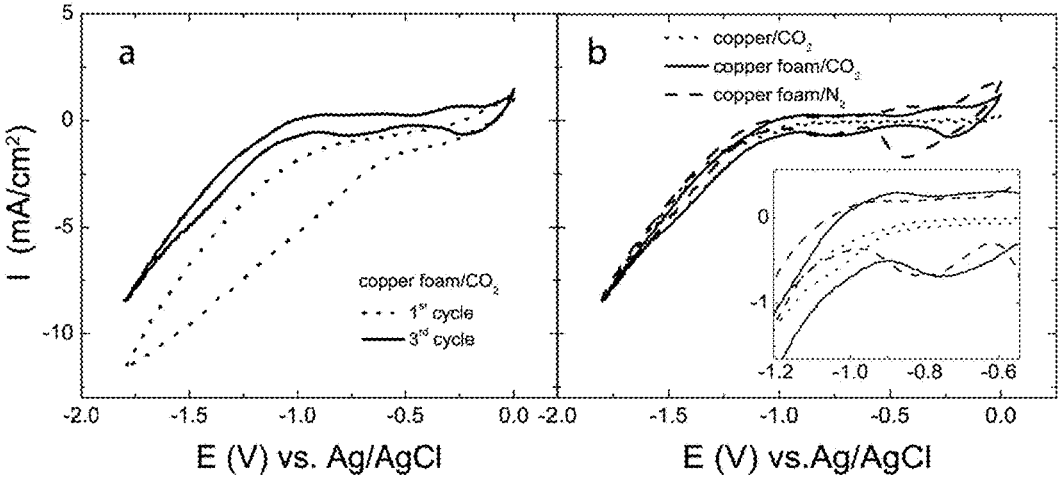
FIG. 7*a* and b present cyclic voltammograms of copper substrate coated with copper nanofoam (15 s) in 0.1 M aqueous $KHCO_3$ purged with: (a) $CO_2$, first and third cycles are shown; (b) $CO_2$ (solid line) or $N_2$ (dashed line) with CV of electropolished smooth copper electrode shown for comparison (dotted line).

FIGS. 7*a* and *b* present cyclic voltammograms of copper substrate coated with copper nanofoam (15 s) in 0.1 M aqueous $KHCO_3$ purged with: (a) $CO_2$, first and third cycles are shown; (b) $CO_2$ (solid line) or $N_2$ (dashed line) with CV of electropolished smooth copper electrode shown for comparison (dotted line). All CVs shown were obtained at 50 mV/s using a two-compartment cell.

Figure 8:
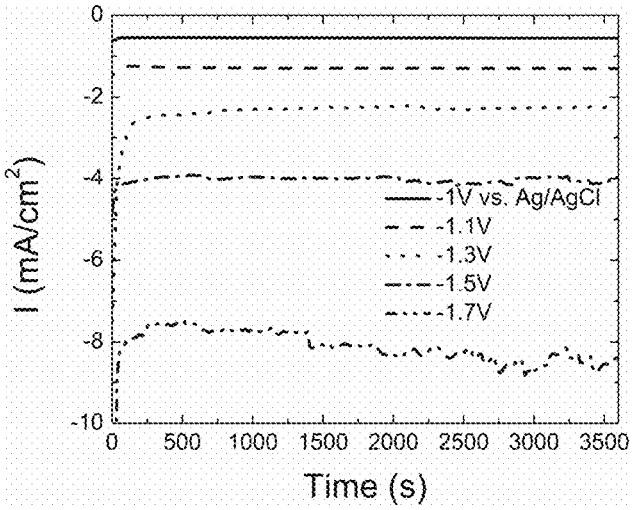
FIG. 8 presents chronoamperograms of a copper substrate coated with copper nanofoam (15 s) in 0.1 M aqueous $KHCO_3$ purged with $CO_2$ at different potentials.

FIG. 8 presents chronoamperograms of a copper substrate coated with copper nanofoam (15 s) in 0.1 M aqueous $KHCO_3$ purged with $CO_2$ at different potentials.

Figure 9:
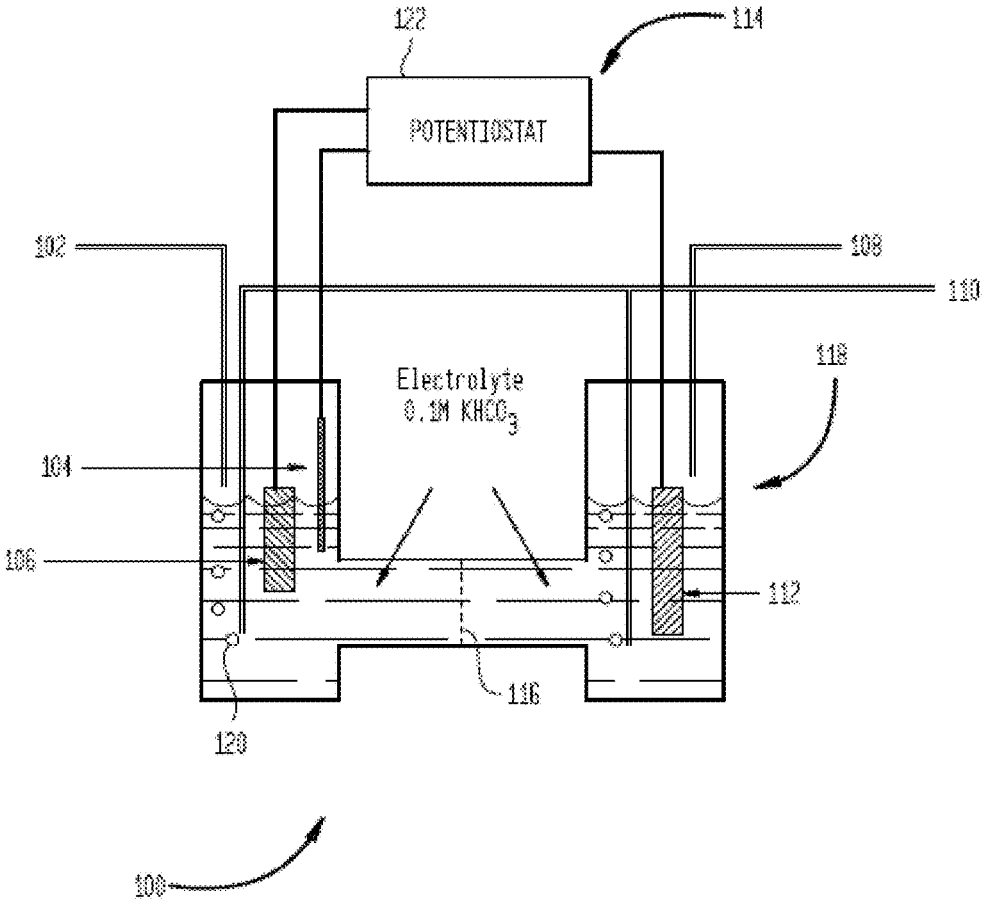
FIG. 9 is a diagrammatic electrocatalytic cell of the present invention.

FIG. 9 is a containment vessel electrocatalytic cell (100) of the present invention. Gaseous products outlets (102) and (108) are situated above the electrolyte level (118), here 0.1 M $KHCO_3$. Reference electrode (e.g., Ag/AgCl) (104) is situated in electrical connection with the electrolyte and in electrical connection with potentiostat (122). The potentiostat (122) is in in electrical connection (114) with a power source (not shown). Catalytic-copper electrode (e.g., copper nanofoam (106), here 2$cm^2$, is in electrical connection with potentiostat (122). $CO_2$ (120) is introduced through $CO_2$ input (110), here at 20 ml/min. $CO_2$ reduction products from catalytic-copper electrode (106), are removed by way of gaseous product outlet (102). Reduction products may include ethane and propylene. The cell is divided by a membrane (116), here a non-reinforced membrane based on chemically stabilized perflurosufonic acid/PTFE copolymer in the acid ($H^+$) form, e.g., Nafion N117® (Dupont). Counter electrode (anode) (112) in electrical connection with potentiostat (122) is here, Pt gauze 4 $cm^2$. The membrane (116) divides the cell into a first compartment containing the anode (112) and a second compartment containing the catalytic-copper electrode (106).

An electrolyte of $KHCO_3$ is preferred but any electrolyte will be suitable if it meets the following: does not undergo chemical reaction across the potential range used for the electrocatalytic reduction of $CO_2$, is not consumed during electrocatalytic reduction of $CO_2$.

This disclosure emphasizes aspects of the disclosed method of making copper nanofoams, the nanofoams themselves, and the methods of using the nanofoams.

Pores are to be broadly understood to mean voids (or bubbles) in a solid typical of nanofoams and further including "gaps" or holes in two dimensional surfaces. Voids or holes from about 1 nanometer ($1\times10^{-9}$ m) to about 500 μm are contemplated. Particular note is made of pores of about 20 to about 500 μm and the ranges of about 20 μm to about 50 μm, and 100 μm to about 200 μm.

Open cell metal nanofoams, also called metal sponges, can be manufactured in a number of ways. Reference is made to foundry or powder metallurgy. In the powder method, "space holders" are used to yield space to the open pores and channels during or after the nanofoam making process. In one casting processes, nanofoams are made by replicas of open-celled other (e.g., polyurethane) nanofoams used as a skeleton.

Scalability of this method is noted. By way of nonlimiting example, multiple copper nanofoam electrodes can be present in a flow system open to introduction of feed stock and collection of products such a propylene and ethane and formic acid.

The invention claimed is:

1. An electrochemical cell for producing formic acid comprising a catalytic copper electrode selected from the group comprising copper nanofoam, copper aerogel, and copper nanoparticles having a faradaic efficiency in producing formic acid of at least about 26%, the catalytic copper electrode having at least about 5 times the electrochemically accessible surface area as determined by the Randles-Sevcik equation at 50 mV/s.

2. The electrochemical cell of claim 1, wherein said catalytic copper electrode has at least about 10 times the electrochemically accessible surface area as determined by the Randles-Sevcik equation at 50 mV/s.

3. The electrochemical cell of claim 1, wherein said catalytic copper electrode is a copper nanofoam electrode.

4. A method for the reduction of $CO_2$ by the steps of (a) providing a membrane divided electrochemical cell comprising an anode in a first cell compartment, a catalytic-copper electrode in a second cell compartment containing an aqueous electrolyte in contact with the anode and catalytic-copper electrode, wherein said catalytic copper electrode is selected from the group comprising copper nanofoam, copper aerogel, and coper nanoparticles, wherein said catalytic-copper electrode has at least about 5 times the electrochemically accessible surface area as determined by the Randles-Sevcik equation at 50 mV/s;

(b) introducing $CO_2$ to said second cell compartment;

(c) exposing said $CO_2$ to said catalytic-copper electrode at a step potential between about −0.8 and about −1.1 V versus the reference electrode;

(d) electrochemically reducing said $CO_2$ and solution by the catalytic-copper electrode in the second cell compartment;

(e) thereby producing formic acid; and, (f) extracting said formic acid from said second compartment.

5. The method of claim 4 wherein said electrolyte is $KHCO_3$.

6. The method or claim 4 wherein said electrolyte is about 0.5 M to about 0.1 M.

7. The method of claim 4 wherein said (e) producing of formic acid is at a faradaic efficiency of at least about 26%.

* * * * *